United States Patent [19]

Takayanagi

[11] Patent Number: 4,484,812

[45] Date of Patent: Nov. 27, 1984

[54] ELECTROSTATIC CHARGING SYSTEM FOR ELECTROPHOTOGRAPHIC COPYING MACHINE

[75] Inventor: Hiroshi Takayanagi, Ebina, Japan

[73] Assignee: Fuji Xerox Co., Ltd., Toky, Japan

[21] Appl. No.: 464,365

[22] Filed: Feb. 7, 1983

[30] Foreign Application Priority Data

Feb. 8, 1982 [JP] Japan ..... 57-18491

[51] Int. Cl.[3] ..... G03G 15/00

[52] U.S. Cl. ..... 355/14 CH; 355/3 CH; 250/324; 361/235

[58] Field of Search ..... 355/14 CH, 3 CH; 250/542, 543, 544, 545, 546, 324, 325, 326; 361/235

[56] References Cited

U.S. PATENT DOCUMENTS 4,028,596 6/1977 Weber ..... 355/14 CH X 4,136,942 1/1979 Nakahata et al. ..... 355/3 CH 4,346,986 8/1982 Kuge et al. ..... 355/14 CH 4,355,884 10/1982 Honda et al. ..... 361/235 X

*Primary Examiner*—A. C. Prescott

*Attorney, Agent, or Firm*—Handal & Morofsky

[57] ABSTRACT

An electrostatic charging system for an electrophotographic copying machine comprises a photoreceptor, electrostatic charger, an a.c. high voltage transformer for driving the electrostatic charger and a photoreceptor current detector. The transformer is enclosed with a conductive casing insulated from ground and one output of the secondary winding of the transformer is connected to the casing so that leakage current generated in the transformer is subjected to be fed back to the transformer itself through the conductive casing, avoiding the leakage current to flow into the photoreceptor current detector, whereby photoreceptor current can be detected with accuracy.

4 Claims, 2 Drawing Figures

ELECTROSTATIC CHARGING SYSTEM FOR ELECTROPHOTOGRAPHIC COPYING MACHINE

BACKGROUND OF THE INVENTION

1. Field of the Invention

The present invention relates to an electrostatic charging system for electrophotographic copying machine, and particularly to a system in which accuracy of detection is elevated in respect to the current flowing through a photoreceptor by means of corona discharge.

2. Description of the Prior Art

In general, an electrophotographic copying machine is provided with a plurality of corona discharging devices effecting suitably charge, transfer, separation, discharge and the like relating to copying steps in the vicinity of the surface of the photoreceptor such as photoreceptor drum or the like.

In such corona discharging devices, the most important parameter is so-called photoreceptor current flowing through the photoreceptor by means of corona discharge. It is a very important requirement for obtaining a copy image of good quality that such photoreceptor current is exactly measured to adjust or control, for example, discharge output.

However, in conventional electrostatic charging systems for electrophotographic copying machine, accurate photoreceptor current could not be detected, because it is affected by leakage current being generated in a power supply circuit for the corona discharging unit, particularly in the case where output of the power supply circuit is a.c. output. More specifically, in such a system, leakage current is generated through stray capacitance between a ground frame and a high voltage cord for transmitting such a.c. output as mentioned above to the corona discharging device, or through internal capacitance of a high voltage power transformer (hereinafter referred to simply as "transformer") itself for the power supply circuit, and further the leakage current thus generated joins with the above-mentioned photoreceptor current, whereby the accurate detection of the photoreceptor current has been prevented. The leakage current produced from the high voltage cord can be suppressed by such a manner that the high voltage cord is either shortened or removed by directly connecting the transformer with the corona discharging device. However, a countermeasure could not be taken against the leakage current being generated from the transformer itself.

SUMMARY OF THE INVENTION

The present invention has been made in view of the above and other disadvantages of the conventional electrostatic charging system for an electrophotographic copying machine.

Accordingly, it is an object of the present invention to provide an electrostatic charging system for an electrophotographic copying machine in which only photoreceptor current can exactly be detected by eliminating such influence which is observed even in the case where leakage current is generated from the transformer of a power supply circuit.

In accordance with the present invention, the provision of the electrostatic charging system for electrophotographic copying machine can be attained by such an arrangement that the transformer is enclosed with a conductive casing electrically insulated from a ground frame, and at the same time, an output terminal on the secondary winding side of the transformer is electrically connected with the casing so that, even if leakage current is generated due to high voltage a.c. output of the transformer, such leakage current is subjected to be fed back to the transformer itself through the above described conductive casing, whereby the leakage current is not permitted to flow into a photoreceptor current detector being electrically connected between a ground frame to which a conductive substrate of the photoreceptor is connected and the output terminal on the secondary winding.

This and other objects of this invention will become apparent in view of the following detailed description and the accompanying drawings.

PREFERRED EMBODIMENT OF THIS INVENTION

An electrostatic charging system for an electrophotographic copying machine according to the present invention will be described in detail hereinbelow in accordance with an embodiment illustrated in the accompanying drawings.

Figure 1:
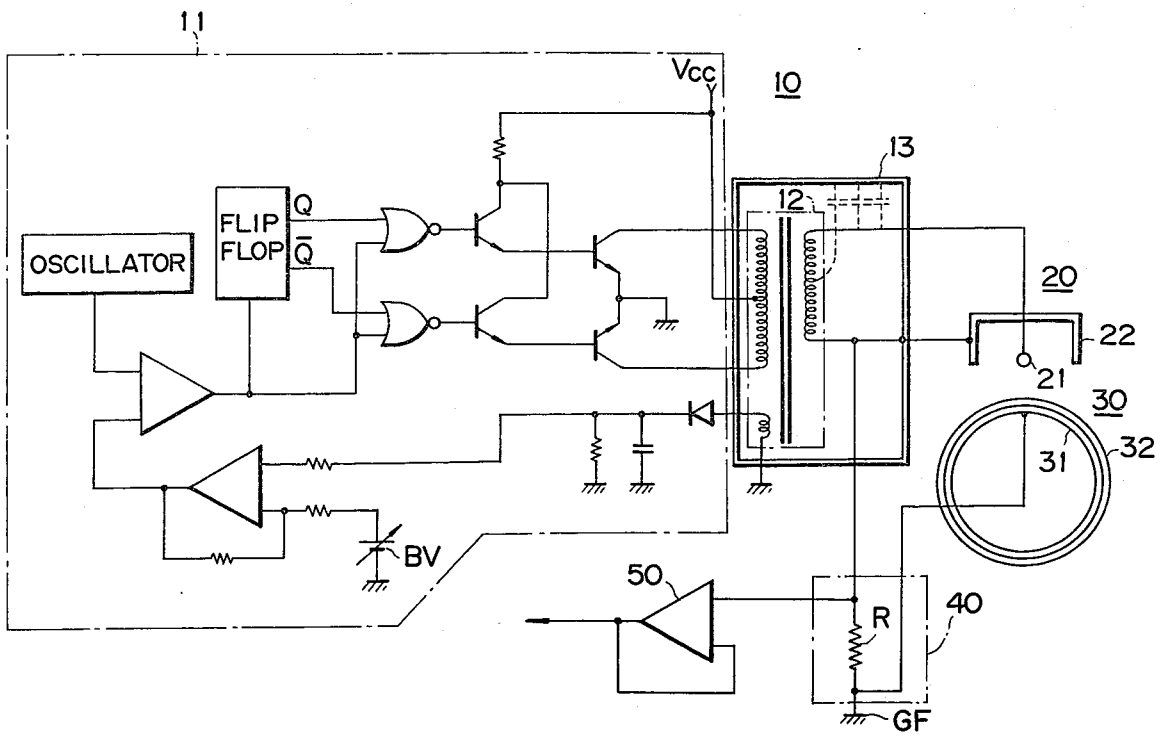
FIG. 1 is a circuit diagram illustrating an embodiment of an electrostatic charging system for an electrophotographic copying machine according to the present invention.

FIG. 1 illustrates an electrical circuit construction in respect of one embodiment of the electrostatic charging system for an electrophotographic copying machine according to the present invention.

Referring to FIG. 1, the system of the present invention is arranged in such that a high a.c. voltage power supply circuit 10 of an ordinary push-pull switching regulator type is constructed by a control unit 11 and a transformer unit 12, output derived from this the power supply circuit 10 is applied to a corona discharging device 20 and at the same time, photoreceptor current being generated in a photoreceptor 30 such as a photoreceptor drum or the like by means of discharge from the corona discharge device 20 is detected by a photoreceptor current detector 40. The photoreceptor current thus detected (more precisely, voltage corresponding to a current value of such photoreceptor current) is amplified by means of an amplifier 50, whereby the amplified photoreceptor current can suitably be measured. The corona discharge device 20 comprises a discharge electrode (discharge wire) 21 connected electrically to an output terminal $T_1$ of the transformer unit 12 and a conductive shielding member 22 connected electrically with an output terminal $T_2$ of the transformer unit 12. Moreover, the photoreceptor 30 consists of a conductive substrate 31 electrically connected to a conductive frame GF and a photoconductive layer 32 generating a predetermined electric charge by means of discharge derived from the corona discharge device 20 superposed on the top of the conductive substrate 31. In addition, the photoreceptor current detector 40 comprises a detection resistor R electrically inserted between the conductive frame GF and the output terminal $T_2$ of the transformer unit 12.

Furthermore, in the electrostatic charging system according to the present invention, the transformer unit 12 is enclosed by a conductive metallic casing 13 insulated electrically from the ground frame GF, and the metallic casing 13 is connected with the output terminal $T_2$ of the transformer unit 12, that is, the metallic casing 13 is electrically connected commonly to the shielding member 22 of the corona discharge device 20 and the detection resistor R of the photoreceptor current detector 40.

Because of such circuit construction as described above, even if leakage current flows from, for example, the output terminal $T_1$ of the transformer unit 12 through a stray capacitance indicated by a broken line in FIG. 1, such leakage current is subjected directly to be fed back to the output terminal $T_2$ of the transformer unit 12 through the metallic casing 13 so that the leakage current does not flow into the detection resistor R of the photoreceptor current detector 40. Only pure photoreceptor current being generated in the photoreceptor 30 due to the discharge from the discharge electrode 21 flows to the detection resistor R.

Thus, when voltage generated across the detection resistor R is amplified by the amplifier 50 and then, the amplified voltage is suitably picked up in accordance with operations of the system of the present embodiment, the photoreceptor current can be measured with a favorable precision.

The control circuit 11 may be a well known stabilizing circuit wherein a variable voltage setting means BV therein is preset to a suitable level so as to obtain an a.c. output corresponding to the preset level from the transformer unit 12. By either manually operating the voltage setting means BV on the basis of the measured value of the photoreceptor current or by automatically controlling the voltage setting means BV by means of output of the amplifier 50, corona discharge with a favorable efficiency can always be made upon the photoreceptor 30.

Figure 2:
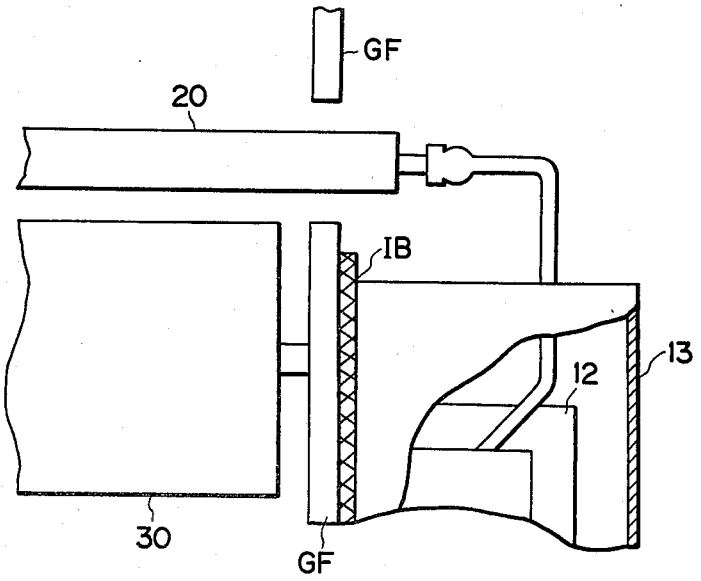
FIG. 2 shows an example of an arrangement of the electrostatic charging system in FIG. 1.

FIG. 2 is an example of an arrangement illustrating the electrostatic charging system, as mentioned above, according to the present invention.

Referring to FIG. 2, the transformer unit 12 is enclosed with the metallic casing 13 and is fixed by means of an insulating filler such as pitch or the like. The metallic casing 13 is attached to a conductive frame GF located in the vicinity of the corona discharge device 20 through an insulating board IB. Thus, the electrical connection illustrated in FIG. 1 can easily be made by the use of the assembly just mentioned above. The mechanical frame GF functions as a frame for grounding as illustrated in FIG. 1, and the conductive substrate 31 (not shown) of the photoreceptor 30 is electrically connected to the frame GF. In this regard, it is to be noted that all the manners for electrical connection in FIG. 2 are made in the same manner of the circuit diagram as illustrated in FIG. 1, and accordingly the rest of the illustration will be omitted herein.

Meanwhile, such electrostatic charging system as described above in an electrophotographic copying machine may be utilized for the respective steps relating to electrophotographic copying as a charging means, a transferring means, a separating means, or a discharging means as discussed in the beginning of this specification. As a consequence, by setting power supplying condition corresponding to these respective steps, the electrostatic charging system according to the present invention can be applied to any of the above means.

Although a preferred embodiment of the invention has been illustrated and described, various modifications and changes may be made without departing from the spirit of the invention or the scope of the appended claims, and each of such modifications and changes is contemplated.

What is claimed is:

1. An electrostatic charging system for an electrophotographic copying machine comprising:
   - a photoreceptor having a photoconductive layer placed on a conductive substrate connected to a grounded conductive frame,
   - electrostatic charging means disposed in the vicinity of said photoreceptor,
   - an a.c. high voltage power transformer for driving said electrostatic charging means, one end of the secondary winding of said transformer being connected to said electrostatic charging means,
   - a current detector connected between the other end of the secondary winding of said transformer and said conductive frame,
   - a conductive housing insulated from said conductive frame and enclosing said a.c. high voltage power transformer, and
   - connecting means for connecting said conducting housing to said the other end of the secondary winding of said transformer.

2. An electrostatic charging system as defined in claim 1 wherein said electrostatic charging means is a corona discharger, a shielding case of said corona discharger being connected to said the other end of the secondary winding of said transformer.

3. An electrostatic charging system as defined in claim 1 wherein said current detector comprises a current detection resistor connected between said the other end of the secondary winding of said transformer and said conductive frame.

4. An electrostatic charging system as defined in claim 1 wherein said conductive housing is insulated from said conductive frame by inserting an insulating board therebetween.

* * * * *